US006939002B2

(12) United States Patent
Janosky et al.

(10) Patent No.: US 6,939,002 B2
(45) Date of Patent: Sep. 6, 2005

(54) METHOD AND APPARATUS FOR PRODUCING A SELECTABLE GLOSS FINISH ON INK JET PRINTS

(75) Inventors: Mark Steven Janosky, Rochester, NY (US); Allan Wexler, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 20 days.

(21) Appl. No.: 10/269,627

(22) Filed: Oct. 11, 2002

(65) Prior Publication Data

US 2004/0070658 A1 Apr. 15, 2004

(51) Int. Cl.[7] ..... B41J 2/01; B41M 5/00

(52) U.S. Cl. ..... 347/106; 347/105; 347/102; 428/32.1

(58) Field of Search ..... 347/106, 101, 347/105, 102, 103, 107; 428/195, 32.1; B41J 02/01, 03/407; B41M 5/00

(56) References Cited

U.S. PATENT DOCUMENTS

| | | | | | |
|---|---|---|---|---|---|
| 3,932,258 | A | | 1/1976 | Brinkman et al. | |
| 3,966,383 | A | | 6/1976 | Bussey, Jr. et al. | |
| 4,258,095 | A | * | 3/1981 | Larson et al. | 428/172 |
| 4,554,181 | A | * | 11/1985 | Cousin et al. | 428/32.3 |
| 4,780,742 | A | * | 10/1988 | Takahashi et al. | 399/320 |
| 5,249,949 | A | * | 10/1993 | Aslam et al. | 425/385 |
| 5,483,331 | A | | 1/1996 | Wayman et al. | |
| 5,660,687 | A | * | 8/1997 | Allen et al. | 162/111 |
| 5,660,962 | A | * | 8/1997 | Malhotra et al. | 430/97 |
| 5,666,592 | A | | 9/1997 | Aslam et al. | |
| 5,695,855 | A | * | 12/1997 | Yeo et al. | 428/196 |
| 5,708,948 | A | * | 1/1998 | Chen et al. | 399/329 |
| 5,709,973 | A | | 1/1998 | Chen et al. | |
| 5,809,032 | A | | 9/1998 | Weeber et al. | |
| 5,887,235 | A | | 3/1999 | Wayman et al. | |
| 5,890,032 | A | | 3/1999 | Aslam et al. | |
| 5,893,666 | A | | 4/1999 | Aslam et al. | |
| 5,897,249 | A | | 4/1999 | Aslam et al. | |
| 6,185,380 | B1 | * | 2/2001 | Abe et al. | 399/18 |
| 6,198,902 | B1 | | 3/2001 | Vaughan et al. | |
| 6,460,687 | B1 | | 10/2002 | Escobedo et al. | |
| 6,464,348 | B1 | * | 10/2002 | Kasperchik et al. | 347/101 |
| 6,650,350 | B2 | * | 11/2003 | Suzuki et al. | 347/212 |
| 2003/0076395 | A1 | * | 4/2003 | Onishi et al. | 347/101 |
| 2003/0126962 | A1 | * | 7/2003 | Bland et al. | 83/13 |

FOREIGN PATENT DOCUMENTS

| | | |
|---|---|---|
| JP | 1182055 | 7/1989 |
| JP | 1182081 | 7/1989 |
| JP | 2121866 | 5/1990 |
| JP | 2002283553 | 10/2002 |
| WO | WO 02/34542 A | 5/2002 |

OTHER PUBLICATIONS

European Search Report dated Aug. 17, 2004.

* cited by examiner

*Primary Examiner*—Lamson Nguyen
*Assistant Examiner*—Leonard Liang

(57) ABSTRACT

A method of selectively producing a glossy or matte finish to an ink jet printed image by applying a clear protective plastic laminate having a glossy finish to the surface of the image, heating the laminate to soften it and then selectively impressing a surface texture into the soften laminate. Pressing the softened laminate against an endless belt having a textured surface forms the surface texture. The laminate is maintained in contact with the belt for a cooling period so as to permit a cold separation of the laminate from the belt.

18 Claims, 1 Drawing Sheet

METHOD AND APPARATUS FOR PRODUCING A SELECTABLE GLOSS FINISH ON INK JET PRINTS

FIELD OF THE INVENTION

The present invention relates generally to the ink jet printing of photographs and other images and more particularly to a method and apparatus for selectively making an ink image with either a glossy or a matte finish.

BACKGROUND OF THE INVENTION

Ink jet prints are quickly reaching high levels of performance with respect to quality, cost and ease or speed at which ink jet prints are produced with the result that ink jet prints are beginning to compete against traditional silver halide produced prints.

One major problem with ink jet prints is durability. In this respect, traditional silver halide produced prints are much more durable than ink jet prints. For example, most dye based ink jet prints can be easily ruined by exposure to water. Pigmented inks are far more durable but have the disadvantage of being less reliable (clogging of ink jet orifices) and being more costly.

One way to improve ink jet print durability is to apply a laminate to the printed surface. This is accomplished by transferring a laminate overcoat, typically a polymer film, from a donor support to the image surface by means of a lamination fuser immediately following the printing process.

A second way to improve durability is by incorporating an overcoat on top of the raw stock media that allows ink to pass through and into an ink receiver layer on the raw stock as the image is printed. The inked image then is run through a fusing process, which seals the overcoat material over the ink receiver layer.

In both cases, the resulting durable print takes on the characteristics of the print stock. For example the print stock may have either a glossy or a matte finish and the laminated or overcoat print will have a like finish. While a majority prefers or at least accepts glossy finish prints, a marketing disadvantage exists for these prints relative to silver halide. This disadvantage is simply the fact that silver halide prints can be printed in many finishes with glossy and matte being the predominate choices. Therefore, it would be desirable to give a customer the option obtaining ink jet prints with either glossy or matte finishes and possibly other textures as well.

Accordingly, it is an object of the present invention to provide an improved method and apparatus for producing a selectable gloss finish in ink jet prints.

Another object of the invention is an improved method and apparatus for providing a laminated ink jet print with a uniform matte finish wherein the laminate has a variable glass transition temperature.

A further object is to provide an improved method and apparatus for providing a laminated ink jet print with a uniform matte finish using heat and pressure to soften a laminate covering the print in order to impress the softened laminate with a textured surface.

Yet another object is to provide a method and apparatus for providing a sheet having a variable humectant content with a selected gloss finish.

SUMMARY OF THE INVENTION

In the present invention, the ink jet printed image is laminated in an inline process so there is no delay between the completion of the print and the lamination process. Immediately after the application of the laminate over the image, the laminated print passes to an embossing apparatus where a matte finish can be selectively applied.

In the embossing apparatus the laminated print is heated to soften the laminate so the surface of the laminate can be textured to impart a matte finish. If a glossy finish is desired, the print is passed through the embosser with out imparting the textured surface. If a matte finish is desired, the laminate, softened by heating, is pressed against the textured surface of a support surface.

In one embodiment of the invention, heating is accomplished by passing the laminated print through a nip formed between a heated pressing roller and a support surface comprising an endless belt. The endless belt has a textured surface and the laminated print is oriented to pass face down through the nip, which puts the laminated surface of the print in contact with the textured surface of the endless belt. Thus, the heated roller pressing against the non-printed rear surface of the print provides sufficient heat to soften all areas of the laminate by uniformly heating to a temperature above the glass transition temperature of even the unplasticized areas of the laminate.

Since the heated roller is in contact with the non-printed rear surface of the print, the roller, after heating the laminate, separates easily and cleanly from the print while the laminated surface remains in contact with the endless belt. The laminated surface continues to remain in contact with the belt and is removed from the belt only after a cooling period.

The cooling period permits a "cold separation" that allows a clean separation of the laminated surface from the belt. This is because maintaining the laminated surface in contact with the textured surface of the belt delays separation until after the laminated surface has cooled to a temperature below the glass transition temperature of even the most highly plasticized region of the laminate.

In another embodiment, the pressing roller is not heated. Instead, the endless belt is passed through a heating zone prior to entering the nip. The pressing roller then presses the print against the heated surface of the endless belt.

If a glossy rather than a matte finish is desired, the laminated print is passed through the nip either without heating so the laminate is not softened, or by opening the nip so that the print is not pressed against the texturing surface. Both procedures will prevent texturing the surface of the laminate so a glossy finish print is produced.

Accordingly, the present invention may be characterized in one aspect thereof by a method for imparting a selected uniform surface finish to an ink jet print including a ink jet printed image on a substrate and a clear thermoplastic protective layer laminated to the substrate over the image, the protective layer having a non uniform glass transition temperature over its surface. The method involves heating to soften the protective layer, passing the print through a nip to press the softened layer against an embossing surface having the desired surface finish to impress the softened protective layer with the desired surface finish, maintaining the softened protective layer in contact with the embossing surface for a cooling period and thereafter separating the protective layer from the embossing surface.

DETAILED DESCRIPTION OF THE INVENTION

Figure 1:
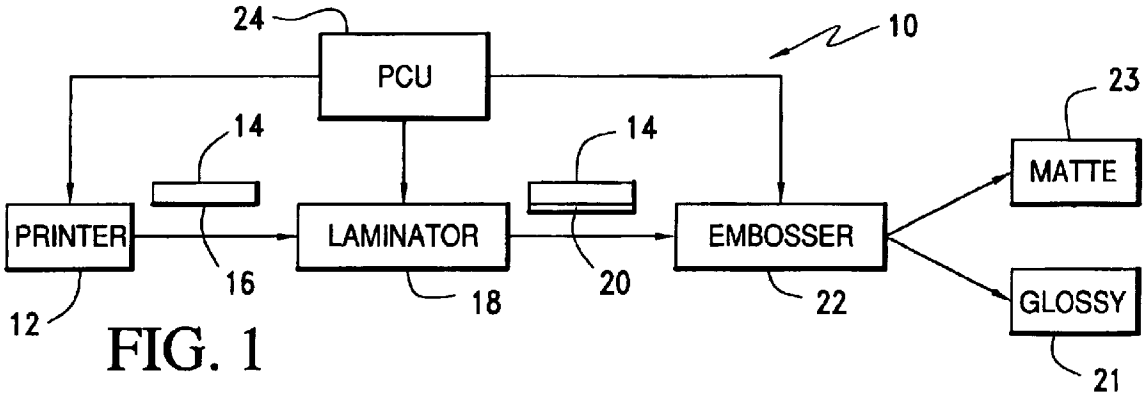
FIG. 1 is a block diagram representing a sequence of steps for producing a matte finish print in accordance with the present invention.

Referring to the drawings, FIG. 1 shows a system generally indicated at 10 for selectively providing a print with a glossy or matte finish. In this respect, the system includes an inkjet printer 12 for creating an image on the surface of a photographic medium such as a photographic paper or the like. From the printer, the print 14 having an inkjet-printed image on one surface 16 is transported to a laminator 18, which applies a protective layer over the printed surface. Preferably the protective layer is in the form of a clear plastic sheet that is laminated to the printed surface.

From the laminator the print 14 having the protective clear plastic layer 20 is transported to an embosser 22. The embosser is operated to selectively provide the print with a matte finish as described hereinbelow. Thus the output of the embosser comprises either a glossy print 21 or a print 23 with a matte finish. The printer, laminator and embosser are all under control of a process control unit or PCU 24, which coordinates the operation of each component.

Figure 2:
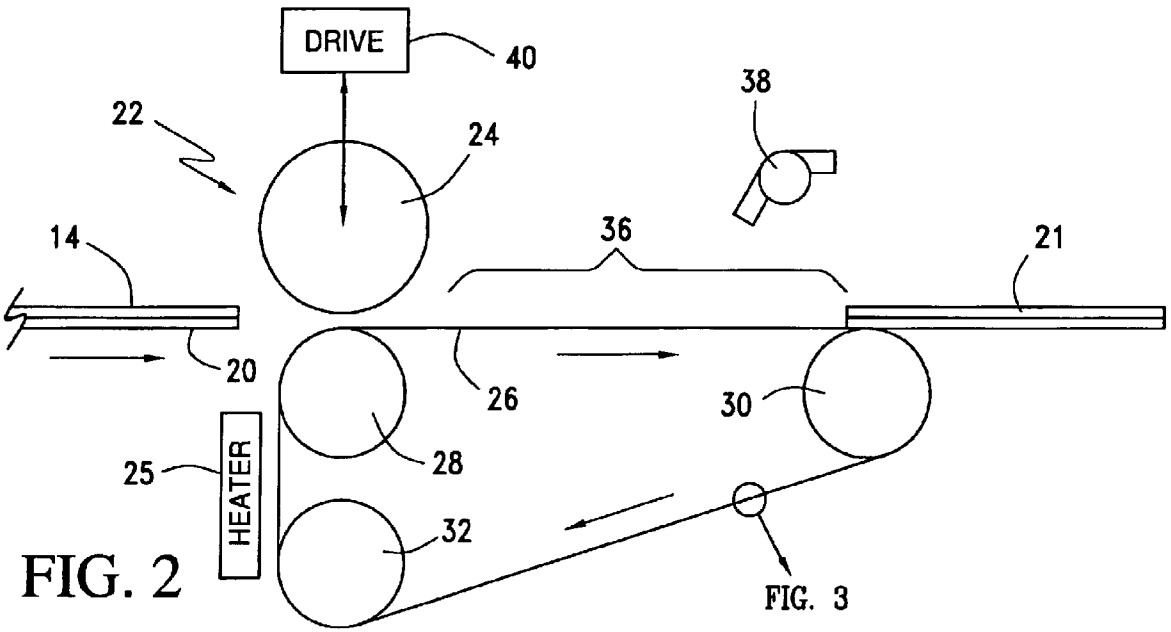
FIG. 2 is a schematic view of a front elevation of an apparatus for providing a matte finish print in accordance with the present invention.

As shown in FIG. 2, the embosser 22 includes a heated pressing roller 24 and an endless embossing belt 26 that is trained about drive/idle rollers 28, 30 and 32. The roller 28 also functions as a backing roller to create a nip with the heated roller 24. The heated roller 24 is arranged for movement with respect to the backing roller 28 so the nip can be selectively opened or closed.

Figure 3:
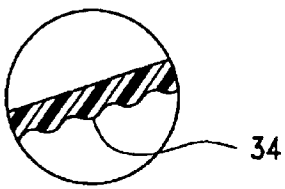
FIG. 3 is a view showing a portion of FIG. 2 on an enlarged scale.

The belt 26 preferably is a seamless belt formed of a high thermal conducting material such as a polyimide and is seamless. Seamless belts are know and are formed for example by spin casting. The belt has an outer surface 34 that is an embossing surface. In one embodiment as best seen in FIG. 3, the outer surface 34 of the belt is a textured surface for purposes set out hereinbelow.

Also shown in FIG. 2 is a heater 25 arranged to heat the embossing belt just prior to entering nip between the roller 24 and the backing roller 28. The heater can be used in place of or in addition to, the heated roller 24. In either case, the area immediately adjacent the nip between the roller 24 and the backing roller 28 (or just prior to the nip) comprises a heating zone so the belt 26 is heated as it enters and passes through this zone. The area identified at 36 that extends downstream from the nip and up to the turn roll 30 comprises a cooling zone. Preferably a cooling means 38 such a fan for forced air circulation or refrigeration system is provided to facilitate the cooling of the belt passing through the cooling zone 36.

In operation, the printer 12 generates an inkjet-printed image on the surface 16 of the photographic paper 14. As is known, an inkjet-printed image constitutes areas of relative light and dark wherein darker areas of the print contain a higher ink density than the lighter areas. The print then enters the laminator where a clear protective laminate 20 is applied over the image on the printed surface.

As noted above, the preferred material for the laminate is a clear plastic, the material having a glass transition temperature that permits softening of the laminate so it can be embossed to simulate a matte finish. For purposes of efficiency of time, the print is not dried prior to the application of the clear plastic protective coating. Consequently, fluid components of the ink system, and in particular the humectant of the ink composition diffuses into the structure of the laminate wherein the concentration of the humectant in any given area of the print is directly proportional to the relative darkness or lightness of the image in that area. The presence of the humectant in the laminate alters the glass transition temperature of the laminate in a known manner in that the magnitude of the change is proportional to the concentration of the humectant. Accordingly, the net effect is that the glass transition temperature of the laminate becomes non uniform and varies over the surface of the printed image.

In this condition, the laminated print is fed to the embosser 22 with its laminated surface 20 oriented towards the textured surface 34 of the embossing belt. If a glossy print is desired, the roller 24 is moved by a drive 40 so as to increase the spacing between the heated roller and the backing roller 28. This allows the laminated print to pass freely between the two rollers and onto the embossing belt 26. If a heater 25 is used, it can be turned off so there is little or no heating of the laminated surface of the print. In this condition, the belt 26 simply transports the print through the cooling zone 36 and the laminated surface is not modified so a glossy finished print 21 drops from the belt.

However, if a matte finish print is desired, the drive 40 is operated to decrease the spacing between the heated roller 24 and the backing roller 28 so a nip is formed. A heater 25 if used is turned on to heat the belt as it passes. In this way, the laminated print entering the nip is heated and the laminated surface 20 is pressed by the roller 24 against the textured surface 34 of the embossing belt 26. The applied heat, which softens the laminate, and the applied pressure is sufficient to impress the laminated surface 20 with the texture of the embossing belt. The laminated surface remains in contact with the embossing belt as the belt transports the laminated print through the cooling zone 36. At the end of the cooling zone there is a cold separation of the print from the belt to produce a matte finish print.

Since the glass transition temperature of the laminate varies across the surface of the print, the constant heat source will result in some areas being heated to well above the local glass transition temperature while other areas are only heated to or slightly above the local glass transition temperature. The areas that are well above the glass transition temperature are softer and tend to stick to the textured surface of the embossing belt. However, maintaining the laminated surface in contact with the embossing belt until cooled provides for a cold separation and avoids the drawbacks associated with a hot release of the laminate from the embossing surface.

Figure 4:
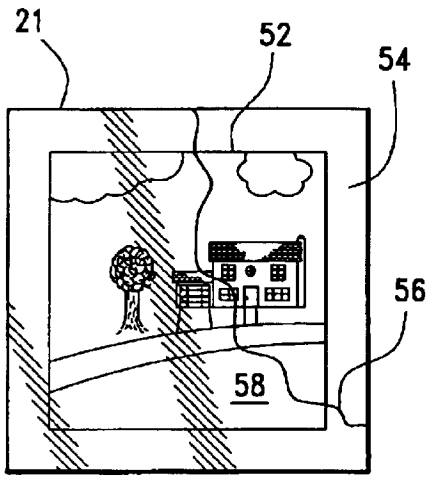
FIG. 4 is a view showing a laminated print according to the present invention.

FIG. 4 shows a print 21 having a matte finish as made according to the method of the present invention. The print includes an ink jet printed area 52 forming the printed image and a boarder area 54 that is free of ink. Covering the entire surface of the print 21 is a clear protective thermoplastic laminate 56 wherein the surface 58 of the protective layer is impressed with a texture imparting a matte finish to the print 21. Incorporated into the laminate is a humectant (not shown) derived from the humectant contained by the ink jet inks used in creating the printed image. As described above, the humectant acts to alter the glass transition temperature of the laminate so that the laminate has a non-uniform glass transition temperature over the surface of the printed area 52.

For purposes of the present invention a "glossy" finish print is considered to be one having a 20° Gloss value of between 70 and 80 whereas a matte finish is considered to be one having a value of 12 to 40. While the invention has been described in the context of converting a glossy finish print to one having a matte finish, it should be appreciated that the invention is applicable to forming a print having any desired surface finish. This is because the laminate, when heated to its glass transition temperature, will embossed with the negative relief image of the belt surface 34. For example, if the laminate prior to application to the print has a less than glossy finish, the method of the present invention can be used to raise the surface finish of the print to a glossy finish. In this case the outer surface 34 of the belt would be smooth rather than textured.

Thus it should be appreciated that the present invention accomplishes its intended objects by providing a method and apparatus for producing a selectable gloss finish on inkjet prints. In accordance with the present invention an ink jet print is provided with a matte finish by embossing the surface of a plastic laminate covering the ink jet printed image. The matte finish impressed into the laminate is uniform over the surface of the print even though the glass transition temperature of the laminate covering the image is non uniform over the print.

In concept, it is easy to convert a glossy laminated image to one with a matte finish. One way is to provide a laminate stock that has the correct finish built into the donor support so the correct finish is provided when the laminate is transferred to the image. A drawback of this method is that the user must have supplies of both glossy and matte finish laminate in inventory and either change the stock as the demand for a particular finish changes or have separate printing and lamination process each utilizing a different lamination package.

A second way to offer various surfaces is to alter the surface after the lamination processes using a separate inline process. This second process would involve an embossing system operable after lamination. In such a process, the laminate material is softened with heat and then is pressed against a textured surface so the laminate takes on the characteristics of the textured surface. The combination of temperature and pressure may be provided by passing the laminated structure through a nip of a pair of opposed rollers, one of which has the desired surface texture and one (perhaps the same one) of which is heated. To provide the desired surface texture, it is preferred that the laminate be heated to a temperature at or slightly above its glass transition temperature to permit flow sufficient for the laminate surface to take on the texture of the texturing surface.

This method has the attribute that it can be turned on or off as desired to add or not add the matte finish, respectively, to the print. This technique, however, also presents several problems related to the interaction of the laminate materials and the inks commonly used in ink jet printing. In this respect, ink jet printing inks commonly incorporate a humectant such as glycol in order to improve the consistency of droplet formation leaving the orifices of the print head. This humectant component of the ink composition quickly migrates into the polymeric laminate material and alters the glass transition temperature of the laminate. This would not be a problem if the humectant were uniformly distributed over the printed surface. In reality, this does not occur and the disposition of the humectant is non-uniform because the ink density and therefore the concentration of the humectant varies across the printed surface. The effect of the humectant on the glass transition temperature is inversely proportional to the concentration of the humectant at any given location in the laminate. Accordingly, there is a lower glass transition temperature where the humectant concentration is highest and a higher glass transition temperature where the humectant concentration is lowest.

Darker areas of the print contain a higher ink density and more humectant than lighter areas of the print so the glass transition temperature for any given area of the laminate is directly related to the amount of ink applied to print that given area. The humectant, by lowering the glass transition temperature and decreasing the modulus or softening the polymer, is acting as a plasticizer for the laminate. As there is a wide range of density variations over the surface area of a print such as a photographic image, the glass transition temperature varies significantly over the surface of the laminate.

The problem caused by the variation in glass transition temperature is manifest by a variation in the gloss level over the surface of the print. This is because constant heat and pressure is applied at a nip between an embossing roller and a pressure roller to soften the laminate so it can take on the surface characteristics of the embossing roller. There is a relatively short contact time in the nip and consequently a very short time to provide the heat needed to raise the laminate to its glass transition temperature. In the areas of highest ink laydown, which have the lowest glass transition temperature, this combination of time and temperature may be more than sufficient to permit the plasticized laminate to take on the texture of the embossing roller.

However, in areas of lowest ink laydown and highest glass transition temperature this combination of time and temperature may not be sufficient, so the laminate can not take on the texture of the embossing roller. In this case the areas of the laminate that are softened and take on the surface finish of the embossing roller will have a different surface finish or gloss than the insufficiently softened areas so the gloss of the print will vary over its surface.

Attempting to improve the uniformity of the gloss by raising the temperature so the combination of time and temperature allow heating the laminate to the glass transition temperature in the least dense areas is not an acceptable solution. The higher temperatures result in damage to areas of the print having a higher ink laydown (and lower glass transition temperature). This is because the increase in temperature to accommodate the least dense areas can result in grossly overheating the areas of highest ink density. The consequence of such over heating is that the highly plasticized laminate in these areas sticks to the embossing roller. Accordingly, as the print passes through the nip, the overheated laminate sticks to the roller and delaminates from the print thereby destroying print quality.

Increasing the nip pressure and using a lower temperature to texture the lighter areas while not damaging the darker areas of the print has not provided an acceptable solution. The increased pressure may initially cause the portions of laminate over the lighter print areas to deform but the laminate material retains some memory so there is recoil from the fully textured condition leading again to a non uniform gloss over the surface of the print.

Attempting to provide a matte finish using a compromise temperature to accommodate all the variations in glass transition temperature over the surface of the print has produced largely unacceptable results. In this case the dark areas (highest humectant concentration) of the print are dull and the lighter areas (lowest humectant concentration) are glossy. Thus when a given heat and pressure is applied by a nip created by the embossing roller and pressure roller, the gloss level of the print varies with the humectant level.

Eliminating the humectant from the printing inks could solve the problem but this is not a viable solution, as it would raise costs of both the ink and the print heads. Allowing an extended drying to allow the humectant to dissipate would solve the problem but this also is a non viable solution as it would increase the time needed to produce a finished product to unacceptable levels.

Another possibility is to insure that there is a uniform wetting of the print over its entire surface regardless of the variations in density. This may be accomplished by including a clear colorless ink in the print process. The amount of this clear ink applied would vary inversely with the density. Thus more of the clear ink would be applied to the least dense (and lightest) areas whereas little or none of the clear ink would be applied to the most dense (and darkest) areas of the print. This would even out the humectant content over the entire print area so there would be a uniform effect on the glass transition temperature of the laminate. This method of providing a uniform gloss is cost prohibitive given the extra ink that is applied.

Having described the invention in detail, what is claimed as new is:

1. A method for imparting a selected uniform matte finish to a photographic print comprising a) ink jet printing an image on a substrate;

b) applying a clear thermoplastic protective layer having a glossy finish to the substrate over the image to form a laminated print and the protective layer after application to the substrate and prior to imparting the matte finish acquiring i) a variable humectant content, and ii) a glass transition temperature that is non uniform over the glossy finish surface and that is inversely proportional to the humectant content;

c) softening the protective layer by heating;

d) pressing the glossy finish surface of the softened protective layer against a texturing surface to impart the glossy surface of the protective layer with the texture of the texturing surface;

e) maintaining the softened protective layer in contact with the texturing surface for a cooling period; and thereafter f) separating the protective layer from the texturing surface to produce a photographic print having a selected uniform matte finish.

2. A method as in claim 1 wherein the humectant acts as a plasticizer for the protective layer and softening the protective layer comprises heating to a temperature that is at least the glass transition temperature of the least plasticized area of the glossy finish surface.

3. A method as in claim 1 wherein the texturing surface comprises a surface of an endless belt and the pressing step is accomplished by passing the laminated print through a nip formed between the endless belt and a roller.

4. A method as in claim 3 comprising moving the endless belt through a cooling zone after passing through the nip while maintaining the softened protective layer in contact with the texturing surface of the belt.

5. A method as in claim 3 wherein the heating comprises passing the endless belt through a heating zone ahead of the nip to heat the belt and then pressing the protective layer against the heated belt as the laminated print passes through the nip.

6. A method as in claim 3 wherein heating comprises heating the roller and pressing the heated roller against the laminated print as the laminated print passes through the nip.

7. A method as in claim 1 wherein the humectant in the protective layer acts as a plasticizer for the protective layer and comprises a humectant in the ink jet printing ink.

8. A method of making an ink jet print having a selected uniform finish comprising:

a) ink jet printing an image onto a print medium, the image being characterized by a non uniform concentration of glass transition altering material;

b) applying a clear protective layer to the substrate over the image to provide a laminated print, the protective layer having a glass transition temperature that is locally altered by the concentration of altering material comprising a humectant incorporated in the ink used in forming the image that is a plasticizer for the protective layer;

c) softening the protective layer by heating;

d) contacting the softened protective layer with an embossing surface having a selected surface finish and impressing the selected surface finish in the softened protective layer;

e) cooling the protective layer while maintaining the contact between the protective layer and embossing surface; and f) separating the protective layer from the embossing surface after said cooling to provide an ink jet print having a selected uniform finish.

9. A method as in claim 8 wherein contacting softened protective layer with the embossing surface provides the protective layer with a matte finish.

10. A method of making an ink ink print having a selected uniform finish comprising:

a) ink jet printing an image onto a print medium, the image being characterized by a non uniform concentration of glass transition altering material;

b) applying a clear protective layer to the substrate over the image to provide a laminated print, the protective layer having a glass transition temperature that is locally altered by the concentration of altering material;

c) softening the protective layer by heating;

d) pressing the protective layer against a surface of an endless belt having a selected surface finish and impressing the selected surface finish in the softened protective layer;

e) cooling the protective layer while maintaining the contact between the protective layer and the endless belt; and f) separating the protective layer from the endless belt after said cooling to provide an ink jet print having a selected uniform finish.

11. A method as in claim 10 wherein the pressing comprises passing the laminated print through a nip formed between the endless belt and a roller.

12. A method as in claim 11 wherein softening the protective layer by heating comprises heating the roller and thereafter passing the laminated print through the nip to heat the print including the protective layer.

13. A method as in claim 11 wherein softening the protective layer by heating comprises first heating the belt by passing the belt through a heating zone prior to entering the nip and thereafter pressing the protective layer against the heated belt.

14. A method as in claim 11 wherein cooling comprises passing the endless belt through a cooling zone after the nip.

15. A method of selectively providing an ink jet printed image with a matte or glossy finish comprising:

a) providing an embosser including an endless belt having a texture surface and a roller movable towards and away from the textured surface to create a nip there between;

b) ink jet printing an image onto a print medium;

c) applying a clear protective layer to the substrate over the image to provide a laminated print with the protective layer having a glossy finish; and d) selectively i) moving the roller away from the endless belt to create a space there between and directing the laminated print through the space to form a glossy finish print, or ii) moving the roller towards the endless belt to creat a nip there between, softening the protective layer by heating, passing the laminated print through the nip and pressing the softened protective layer against the textured surface and thereafter maintaining the protective layer in contact with the textured surface after passing through the nip for a cooling period prior to separating the print from the textured surface to form a matte finish print.

16. A method as in claim 15 comprising heating the roller for heating the protective layer.

17. A method as in claim 15 comprising passing the endless belt through a heating zone prior to entering the nip for heating the protective layer.

18. A method as in claim 15 wherein the protective layer has a variable plasticizer content and a glass transition temperature that is inversely proportional to the plasticizer content and heating the protective layer comprises heating to a temperature that is at least the glass transition temperature of the least plasticized portion of the protective layer.

* * * * *